US010750818B2

(12) United States Patent
Rogers et al.

(10) Patent No.: US 10,750,818 B2
(45) Date of Patent: Aug. 25, 2020

(54) ADJUSTABLE SHOE

(71) Applicant: Akilah Wearable Tech, LLC, Evanston, IL (US)

(72) Inventors: Ariel Rogers, Chicago, IL (US); Sebastien Presume, New Rochelle, NY (US)

(73) Assignee: AKILAH WEARABLE TECH, LLC, Evanston, IL (US)

( * ) Notice: Subject to any disclaimer, the term of this patent is extended or adjusted under 35 U.S.C. 154(b) by 351 days.

(21) Appl. No.: 15/395,635

(22) Filed: Dec. 30, 2016

(65) Prior Publication Data

US 2017/0340051 A1 Nov. 30, 2017

Related U.S. Application Data

(60) Provisional application No. 62/372,457, filed on Aug. 9, 2016, provisional application No. 62/343,788, filed on May 31, 2016.

(51) Int. Cl.

| | |
|---|---|
| ***A43B 13/14*** | (2006.01) |
| ***A43B 3/00*** | (2006.01) |
| ***A43B 21/30*** | (2006.01) |
| ***A43B 3/24*** | (2006.01) |
| ***A43B 13/28*** | (2006.01) |
| ***A43B 7/38*** | (2006.01) |
| ***A43B 13/16*** | (2006.01) |
| ***A43B 21/24*** | (2006.01) |

(52) U.S. Cl.

CPC ..... *A43B 13/141* (2013.01); *A43B 3/0005* (2013.01); *A43B 3/246* (2013.01); *A43B 7/38* (2013.01); *A43B 13/16* (2013.01); *A43B 13/28* (2013.01); *A43B 21/24* (2013.01); *A43B 21/30* (2013.01)

(58) Field of Classification Search

CPC ..... A43B 13/141; A43B 13/16; A43B 13/28; A43B 3/0005; A43B 3/246; A43B 3/24; A43B 3/248; A43B 3/26; A43B 7/38; A43B 21/36; A43B 21/42; A43B 21/433; A43B 21/437; A43B 21/24; A43B 21/30; A43B 3/244

USPC ..... 36/100

See application file for complete search history.

(56) References Cited

U.S. PATENT DOCUMENTS 2,934,840 A * 5/1960 Marion Mistarz ..... A43B 13/34 36/34 R
5,035,094 A * 7/1991 Legare ..... B63B 15/0083 343/903
5,309,651 A * 5/1994 Handel ..... A43B 21/433 36/100
5,729,912 A * 3/1998 Gutkowski ..... A43B 3/26 36/93

(Continued)

*Primary Examiner* — Alissa J Tompkins
*Assistant Examiner* — F Griffin Hall
(74) *Attorney, Agent, or Firm* — BakerHostetler

(57) ABSTRACT

A shoe configured to adjust from a first configuration having a first height to a second configuration having a second height includes a sole. Sole includes a toebox, a shank, and a seat. The shank is rotatably connected to the toebox and the seat. The shoe also includes a heel assembly mounted to the seat. The heel assembly includes a collapsible exterior shell that adjusts the shoe between the first configuration and the second configuration, the first height of the first configuration being greater than the second height of the second configuration.

3 Claims, 18 Drawing Sheets

(56) References Cited

U.S. PATENT DOCUMENTS

| | | | | |
|---|---|---|---|---|
| 7,766,346 | B2 * | 8/2010 | Spanier | A63C 3/04 280/11.12 |
| 2012/0055048 | A1 * | 3/2012 | Haupt | A43B 3/24 36/34 R |
| 2015/0157087 | A1 * | 6/2015 | Blumenthal | A43B 21/42 36/100 |
| 2015/0201704 | A1 * | 7/2015 | Huber | A43B 3/246 36/25 R |
| 2015/0290074 | A1 * | 10/2015 | Koenig | A43B 3/001 601/46 |
| 2016/0235161 | A1 * | 8/2016 | Edwin | A43B 3/0005 |
| 2017/0213095 | A1 * | 7/2017 | Li | A43B 3/0021 |
| 2017/0245640 | A1 * | 8/2017 | Cheng | A47B 91/024 |

* cited by examiner

ADJUSTABLE SHOE

CROSS-REFERENCE TO RELATED APPLICATIONS

This application claims priority to U.S. Provisional Application No. 62/343,788, filed May 31, 2016, and U.S. Provisional Application No. 62/372,457, filed Aug. 9, 2016, the contents of each of which is hereby incorporated by reference in its entirety.

TECHNICAL FIELD

This disclosure relates generally to shoes that have adjustable heights, and specifically to shoes with heels that extend and compress.

BACKGROUND

High heel shoes, such as pumps, platforms, and stilettos are considered to be aesthetically pleasing types of apparel. However, the heights of the heels of these types of shoes, and the subsequent distortion of natural body mechanics due to these heel heights may cause temporary discomfort, as well as long term injuries.

SUMMARY

While convertible heel shoes that have adjustable heel heights are known, these designs have several limitations, including that they lack aesthetic appeal. The aesthetic aspects of high heel shoes are of heightened importance relative to other types of shoes. The inventors of the present disclosure appreciated that the height adjustment mechanism of an adjustable height shoe should, like the rest of the shoe, be aesthetically pleasing.

In a first aspect of the present disclosure, a shoe configured to adjust from a first configuration having a first height to a second configuration having a second height includes a sole. Sole 30 includes a toebox, a shank, and a seat. The shank is rotatably connected to the toebox and the seat. The shoe also includes a heel assembly mounted to the seat. The heel assembly includes a collapsible exterior shell that adjusts the shoe between the first configuration and the second configuration, the first height of the first configuration being greater than the second height of the second configuration.

In a second aspect of the present disclosure, a method of adjusting a height of a shoe includes multiple steps. The shoe has a sole that includes a toebox, a shank, and a seat. The shank is rotatably connected to the toebox and the seat. The shoe has a heel assembly mounted to the seat. The heel assembly includes a collapsible exterior shell. The method includes a first step of adjusting the shell from a first configuration having a first height to a second configuration having a second height. The first height is greater than the second height. The method further includes a step of adjusting the shell from the second configuration to the first configuration. Additionally, the method includes rotating the toebox and the seat relative to the shank during each of the actuating steps.

In a third aspect of the present disclosure, a shoe is configured to adjust from a first configuration having a first height to a second configuration having a second height. The shoe includes a sole including a toebox, a shank, and a seat. The shoe also includes a heel assembly having a base mounted to the seat. The heel assembly includes a shell extending from the base. The shell includes a first cylindrical component that has a sidewall having an outer surface on which external threads are disposed. The shell also includes a second cylindrical component that has a sidewall that defines a recess and has an inner surface on which internal threads are disposed. The internal threads are configured to mate with the external threads such that the first cylindrical component and the second cylindrical component telescope in relation to one another as the shoe adjusts from the first configuration to the second configuration.

BRIEF DESCRIPTION OF THE DRAWINGS

The foregoing summary, as well as the following detailed description of illustrative embodiments of the adjustable height shoe of the present application, will be better understood when read in conjunction with the appended drawings. For the purposes of illustrating the adjustable shoe of the present application, there is shown in the drawings illustrative embodiments. It should be understood, however, that the application is not limited to the precise arrangements and instrumentalities shown. In the drawings.

DETAILED DESCRIPTION OF THE ILLUSTRATIVE EMBODIMENTS

Aspects of the disclosure will now be described in detail with reference to the drawings, wherein like reference numbers refer to like elements throughout, unless specified otherwise. Certain terminology is used in the following description for convenience only and is not limiting.

Figure 1A:
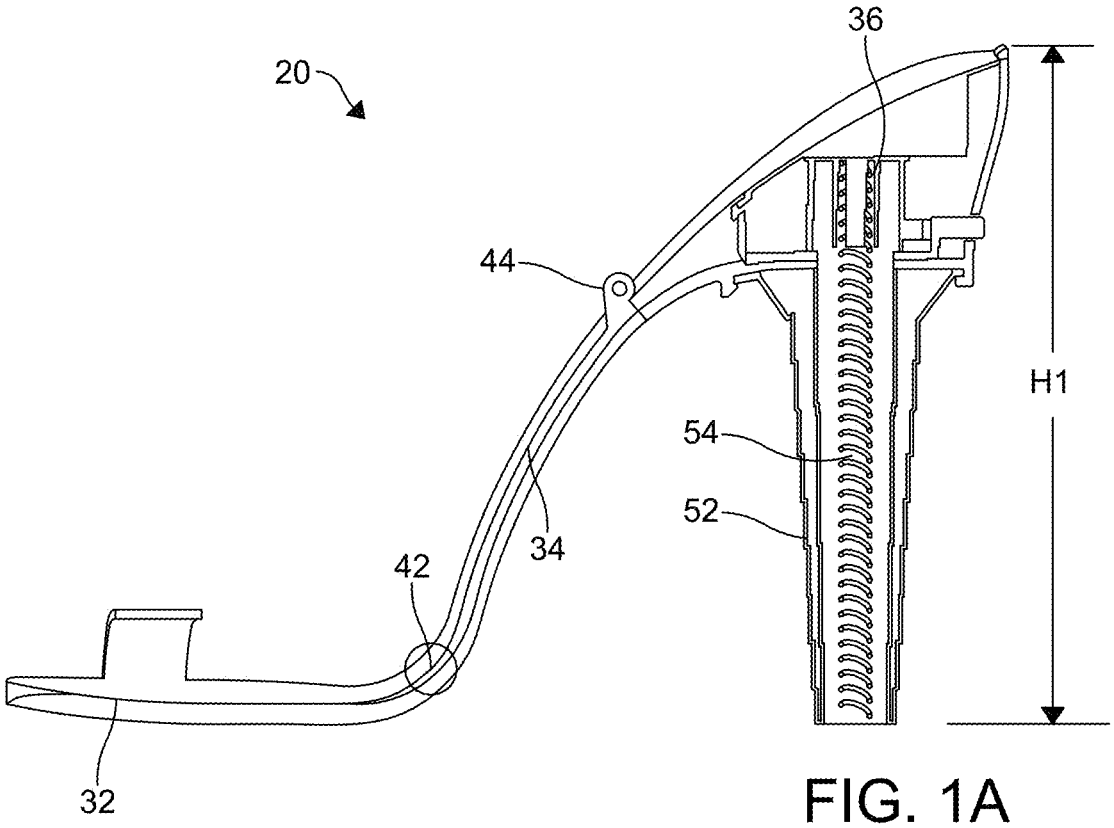
FIG. 1A is a side cross-sectional view of a first shoe configured to adjust from a first configuration having a first height to a second configuration having a second height, with the shoe in the first configuration
Figure 1B:
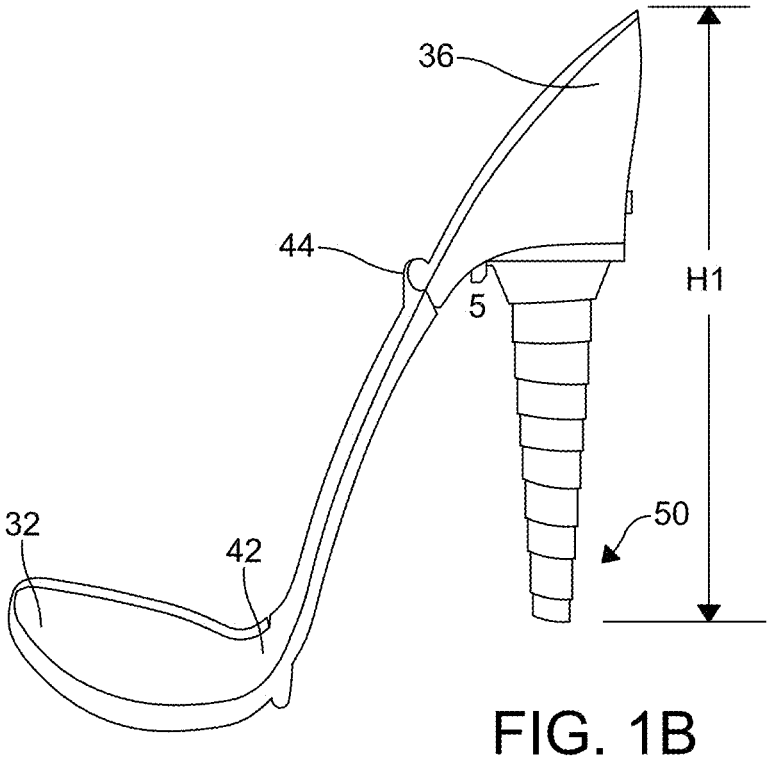
FIG. 1B is a perspective view of the first shoe in the first configuration.
Figure 2:
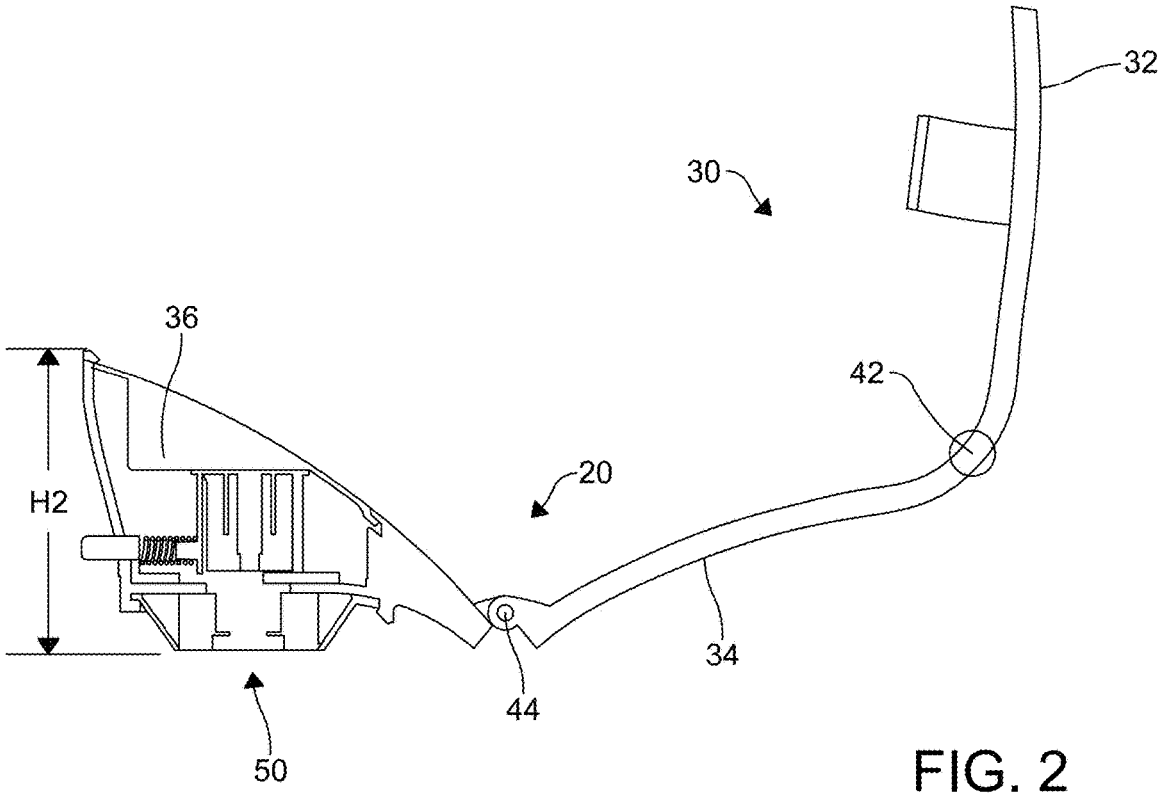
FIG. 2 is a cross-sectional view of the shoe in FIG. 1A adjusting between the first configuration and the second configuration.
Figure 3:
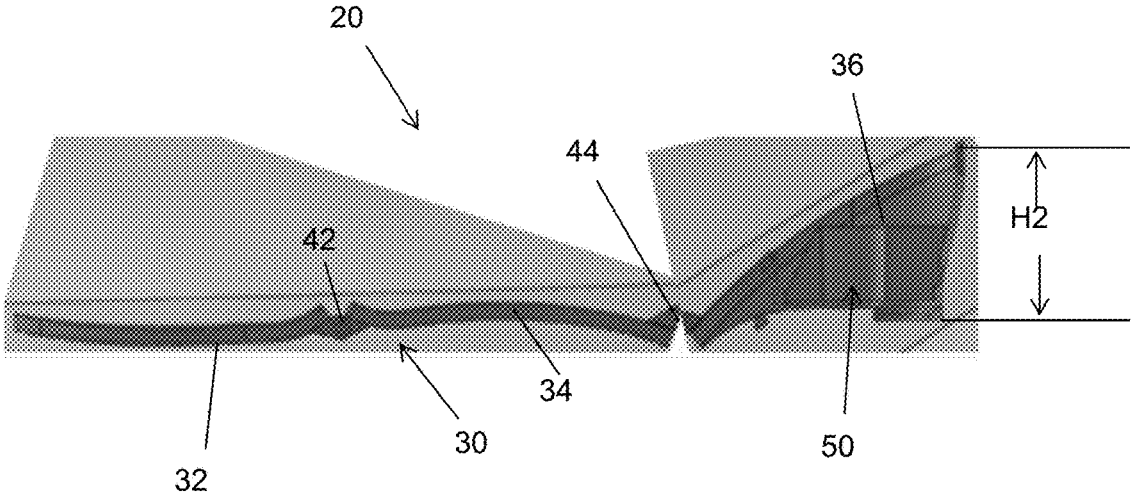
FIG. 3 is a cross-sectional view of the shoe in FIGS. 1A and 2 with the shoe in the second configuration.
Figure 4A:
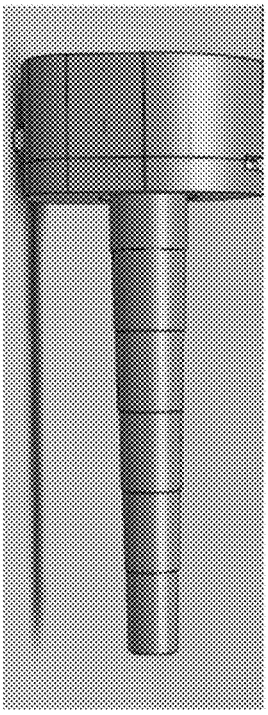
FIGS. 4A, and 4B are side views of a heel assembly of the shoe shown in FIGS. 1A-3, with the assembly in an extended state.
Figure 4B:
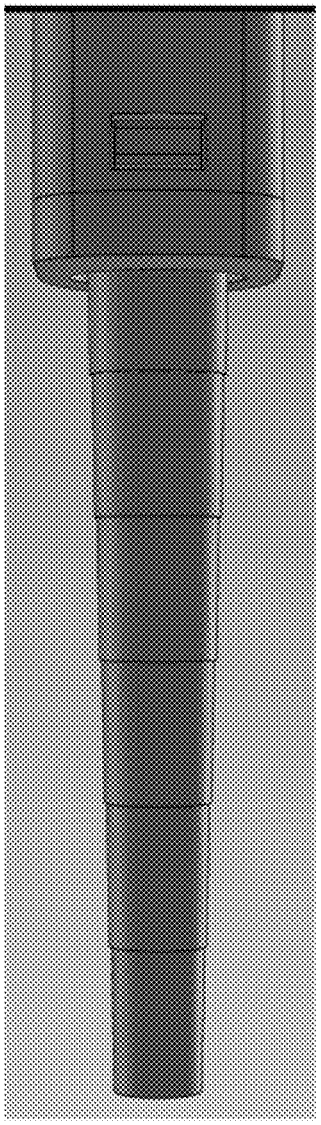
Figure 4C:
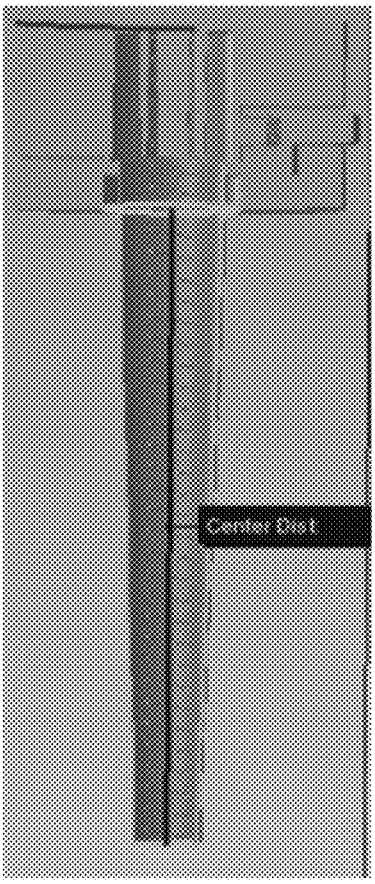
FIG. 4C is a side cross-sectional view of the heel assembly shown in FIGS. 4A and 4B, with the heel having a height of 4.024 inches, with the assembly in the extended state.
Figure 5A:
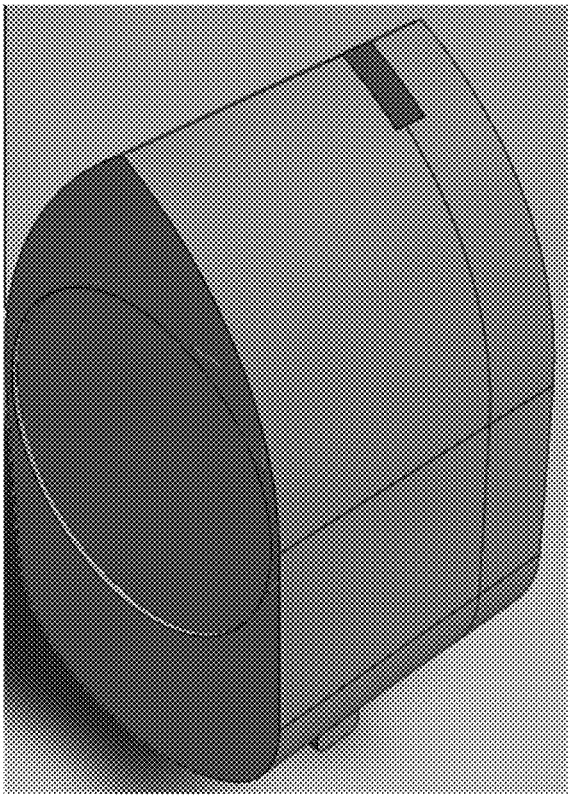
FIGS. 5A and 5B are perspective views of the heel assembly shown in FIGS. 4A, 4B and 4C, with the assembly in a compressed state.
Figure 5C:
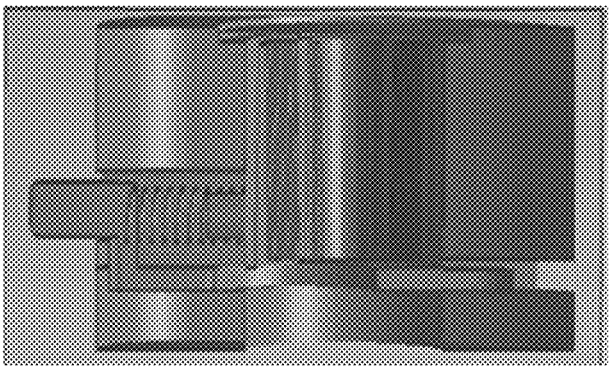
FIG. 5C is a cross-section view of the heel assembly shown in FIGS. 4A, 4B, 4C, 5A, and 5B, with the assembly in the compressed state.
Figure 5B:
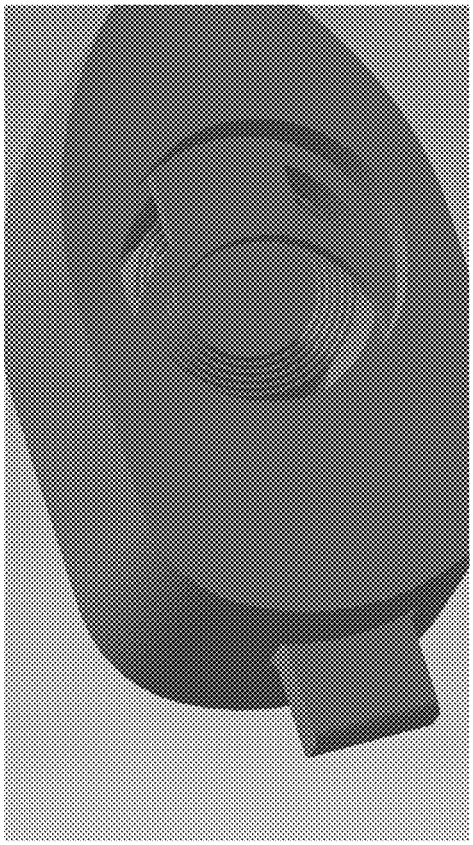

Referring to FIGS. 1A-3, a shoe 20 configured to adjust between a first configuration shown in FIGS. 1A and 1B to a second configuration shown in FIG. 2. In the first configuration of the shoe 20, the shoe is configured as a high heel and has a first height H1. In the second configuration of the shoe 20, the shoe is configured as a flat or low-heel shoe and has a second height of H2. As shown in FIGS. 1A, 1B and 3, the first height H1 of the first configuration is greater than the second height H2 of the second configuration.

With reference to FIGS. 1A-3, as well as FIGS. 13A, 13B, 13C, and 13D, the shoe 20 includes a sole 30 that has a toebox 32, a shank 34, and a seat 36. The toebox 32 corresponds generally to the location in the shoe where a wearer's toes are positioned. The shank 34 corresponds generally to the location in the shoe where the wearer's arch is positioned. The seat 36 corresponds generally to the location in the shoe where the wearer's heel is positioned. Each of the toebox 32, shank 34, and seat 36 may be configured to have a relatively rigid construction that provides only minimal flexing for the wearer. Alternatively, one or more of the toebox 32, shank 34, and seat 36 may have a flexible construction that bends during wear. Alternatively still, a portion of any of the toebox 32, shank 34, and seat 36 may have a flexible construction. For example, shank 34 and seat 36 may have ridge constructions formed of rigid plastic. A portion or all of toebox 32 may have a flexible construction made of semi-flexible rubber. One or more of the toebox 32, shank 34, and seat 36 may also be formed of rigid panels that flex in relation to one another. Additionally, sole 30, including toebox 32, shank 34, and seat 36 may be formed as a custom orthotic, for example, using 3D printing/stereolithography.

The shank 34 connects to the toebox 32 by a first hinge 42. The shank 34 connects to the seat 36 by a second hinge 44. The first hinge 42 and the second hinge 44 each provide for axes of rotation between the shank 34 and the toebox 32 and the shank and the seat, respectively, that are parallel to one another. Hinges 42, 44 enable sole 30 to adjust between a bent state, corresponding to the first configuration, shown in FIGS. 1A and 1B, and a flat state, corresponding to the second configuration, shown in FIG. 3. Either or both of hinges 42, 44 may be ratcheting hinges that releasably lock the positions of toebox 32 and seat 36 relative to shank 34. Hinges 42, 44 may extend along the entire width of the portion of shoe 20 in which they are disposed. Alternatively, each hinge 42, 44 may include two side portions that attach to the sole only at the outer edges. In both the first configuration and the second configuration, hinges 42, 44 may be attached to the toebox 32, shank 34, and seat 36 so as to provide for flexing of the sole 30.

Figure 13A:
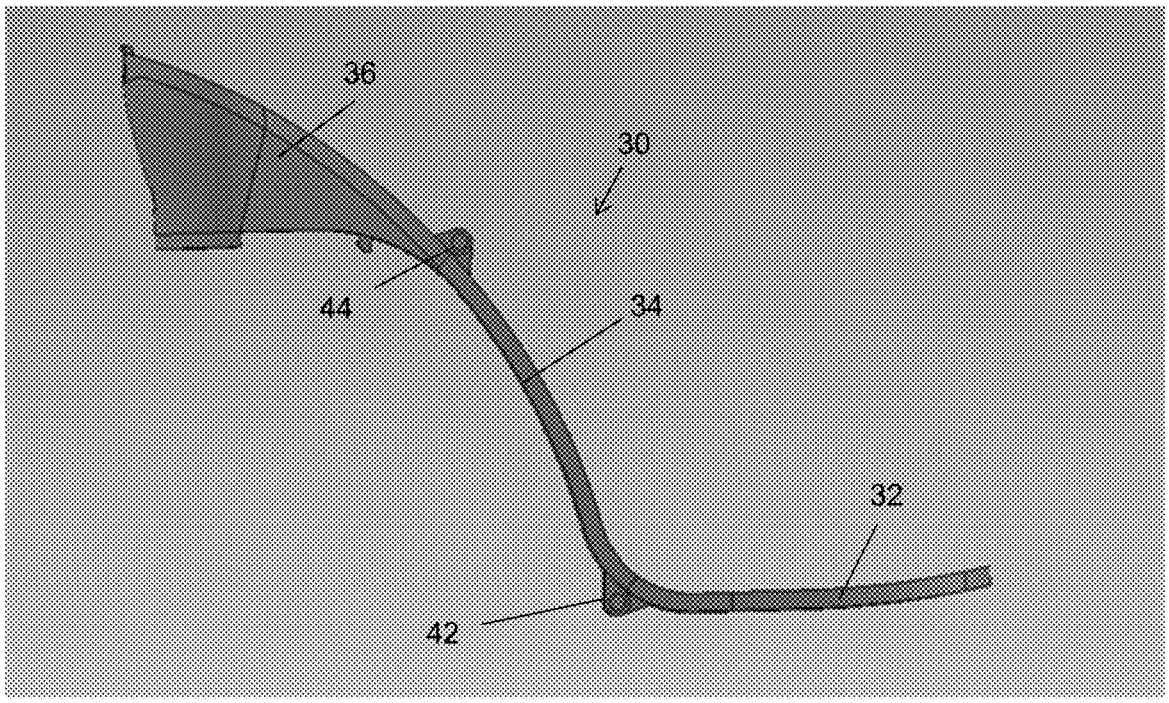
FIGS. 13A, 13B, 13C, and 13D are views of an embodiment of a sole of a shoe configured to adjust between the first configuration and the second configuration.
Figure 13B:
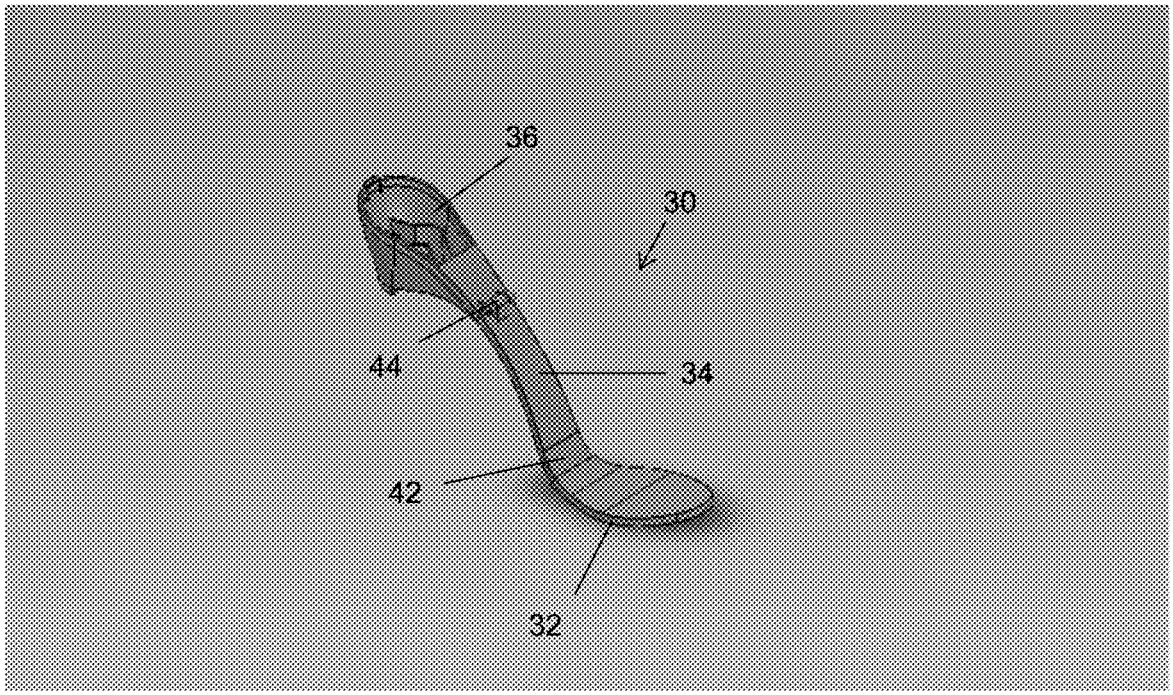
Figure 13C:
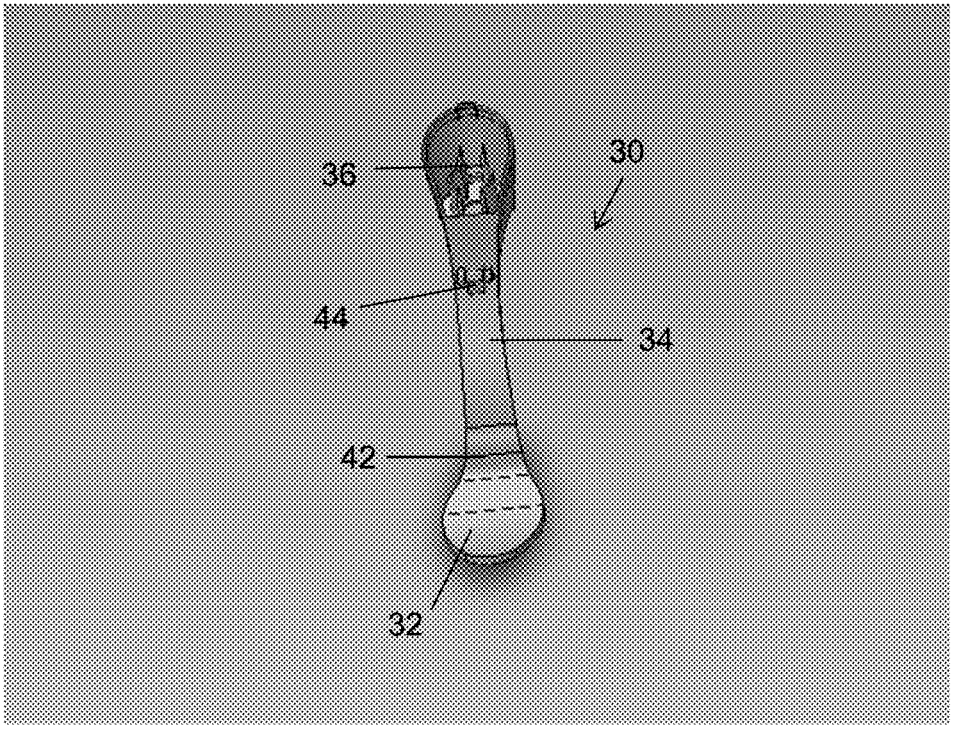
Figure 13D:
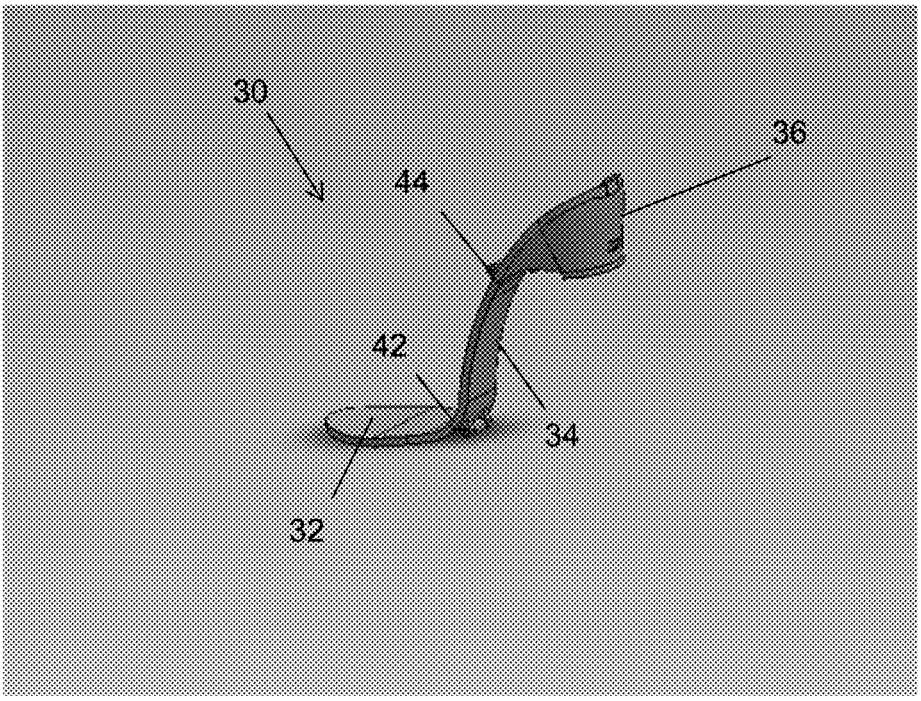
Figure 13E:
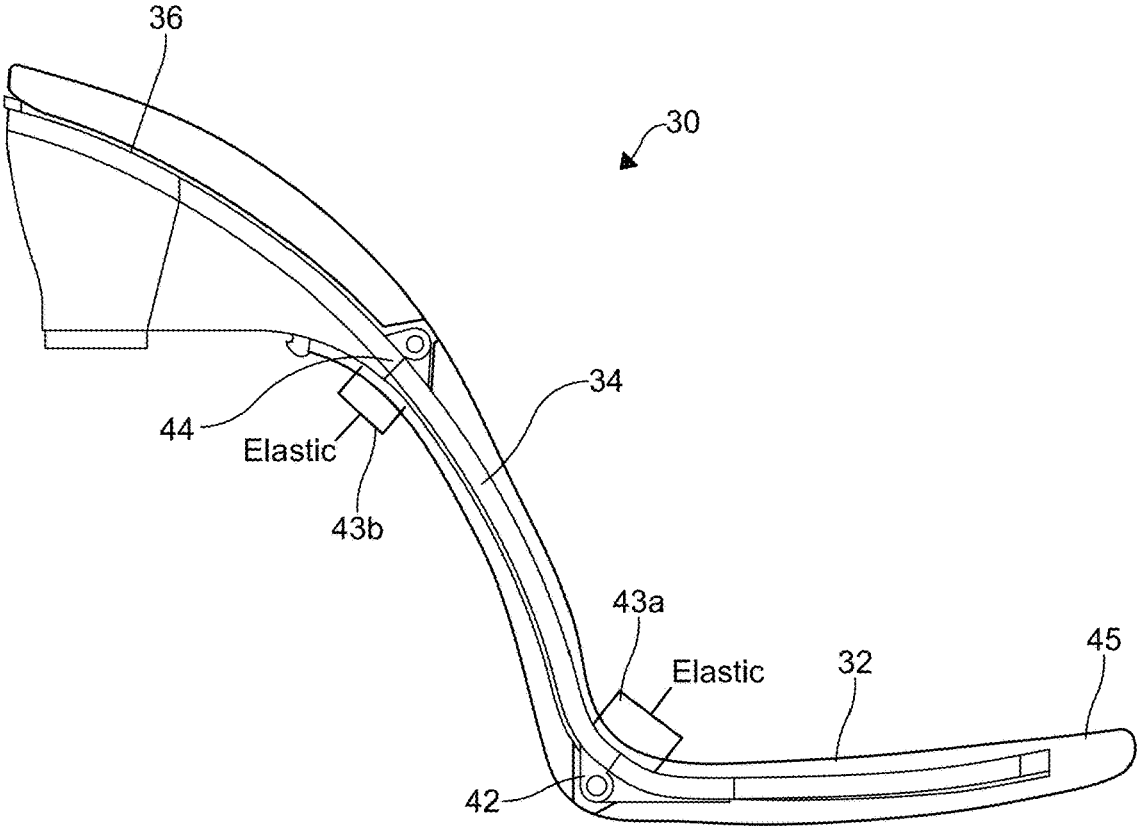
FIGS. 13E and 13F are views of the embodiment of the sole shown in FIGS. 13A, 13B, 13C, and 13D including elastic covers and a skin.
Figure 13F:
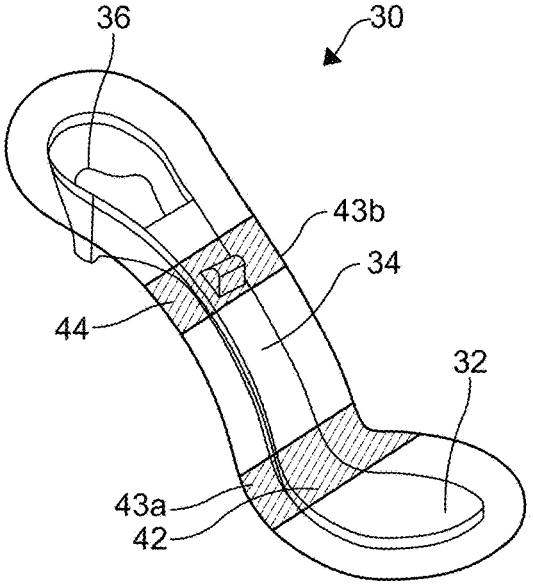
Figure 14A:
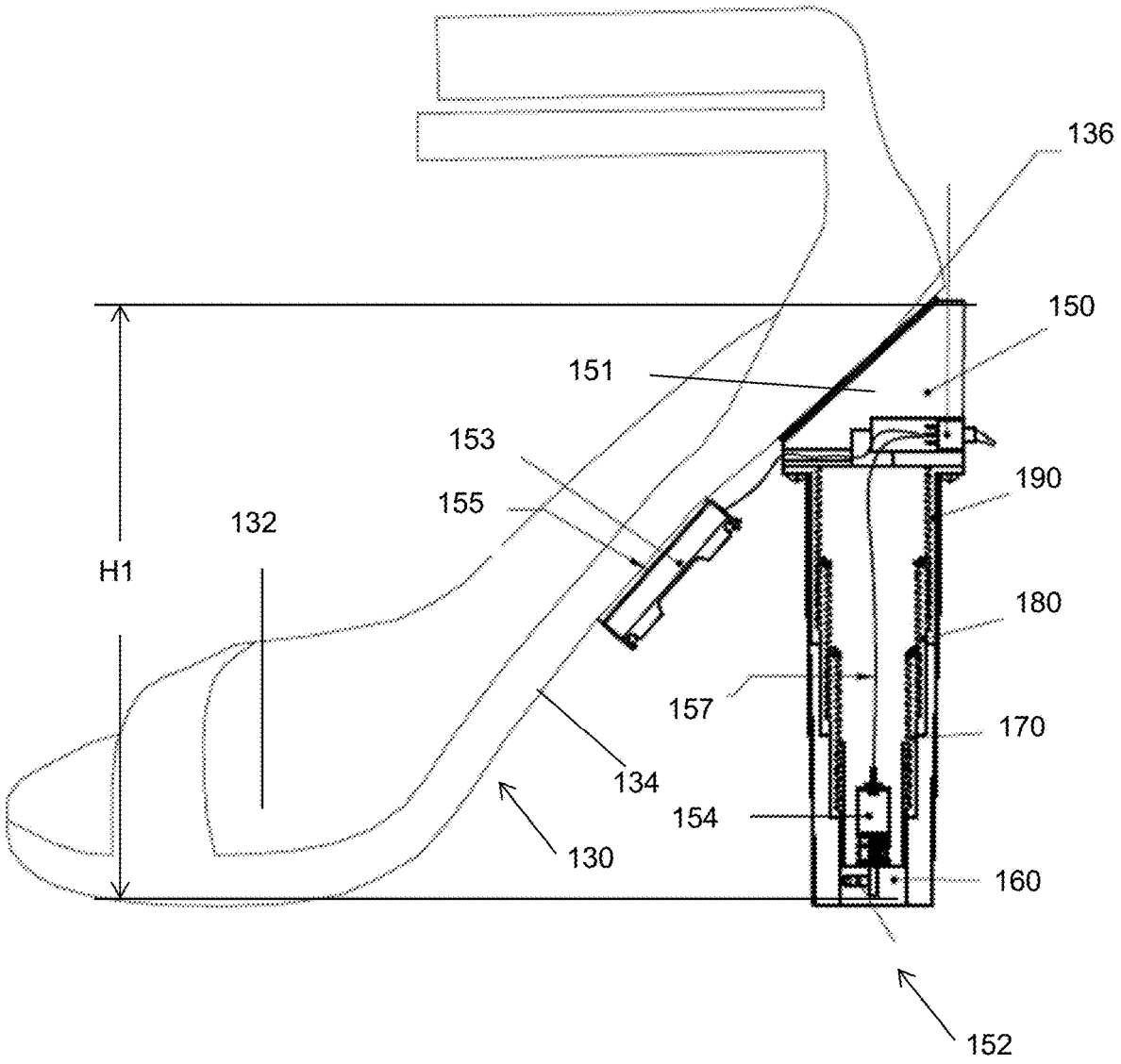
FIG. 14A is a side view of a second shoe configured to adjust from a first configuration having a first height to a second configuration having a second height, with the shoe in the first configuration.
Figure 14B:
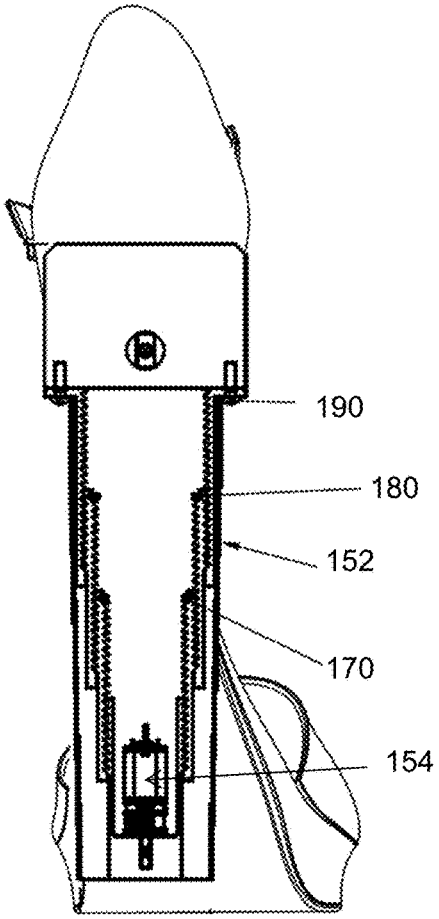
FIG. 14B is a rear view of the shoe shown in FIG. 14A in the first configuration.
Figure 15:
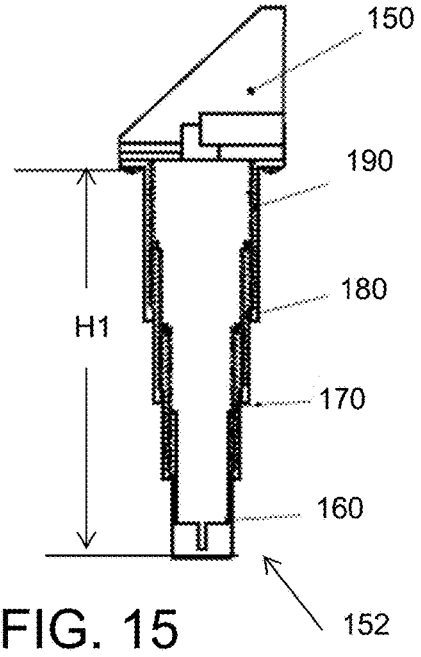
FIG. 15 is a cross-sectional side view of a heel assembly of the shoe shown in FIGS. 14A-14C with the heel assembly in an extended state.
Figure 14C:
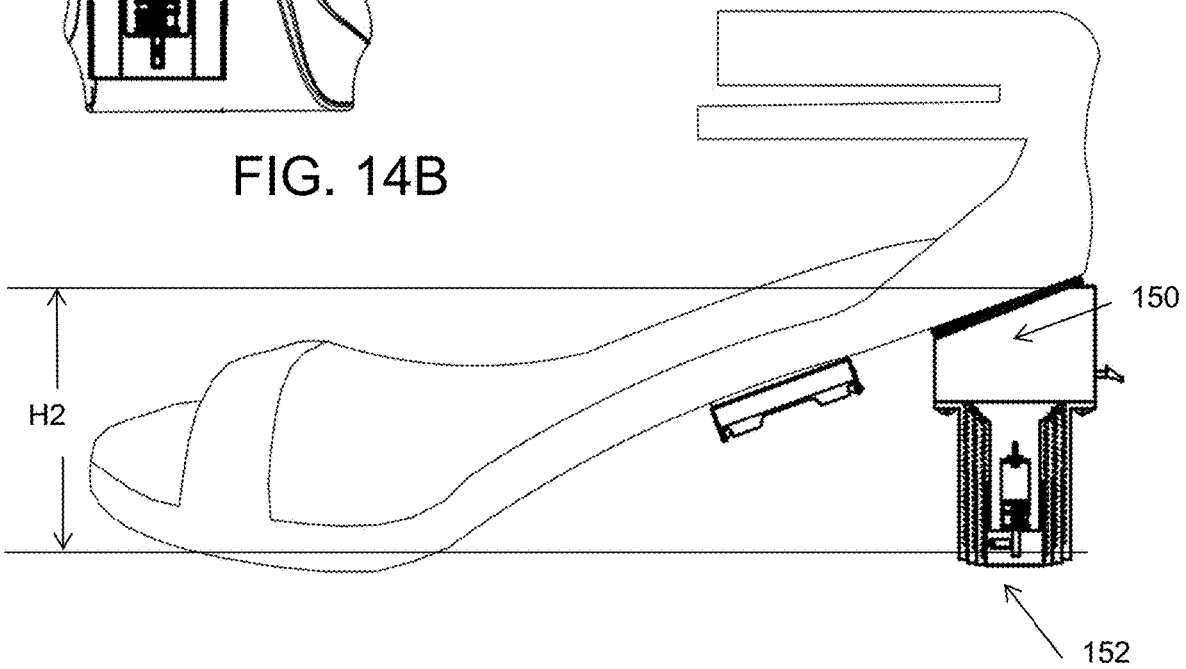
FIG. 14C is a side view of the shoe shown in FIGS. 14A and 14B in the second configuration.

With reference to FIGS. 13E and 13F, an elastic cover 43 may be disposed on the sole 30 on the opposite side on hinges 42, 44. For example, if hinge 42 extends downward from the bottom of sole 30, elastic cover 43*a* may be disposed on the top side of the sole 30. If hinge 44 extends upward from the top of sole 30, elastic cover 43*b* may be disposed on the bottom side of the sole 30. As shown in FIG. 13E, sole 30 may also be covered in a skin 45 that provides a layer of cushioning to the wearer. For example, skin 45 may include a rubber or foam component.

Figure 6A:
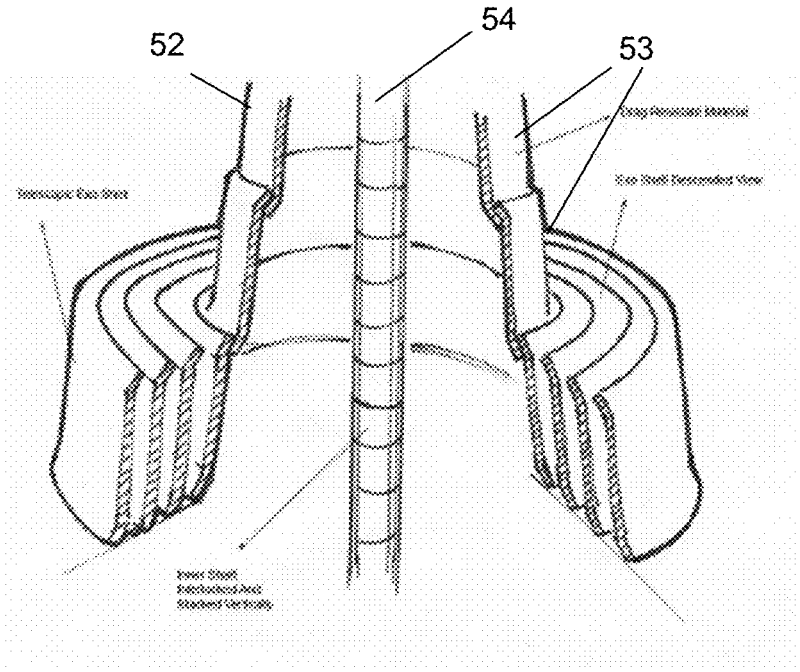
FIGS. 6A and 6B are schematic perspective views collapsible exterior shells of heel assemblies.
Figure 6B:
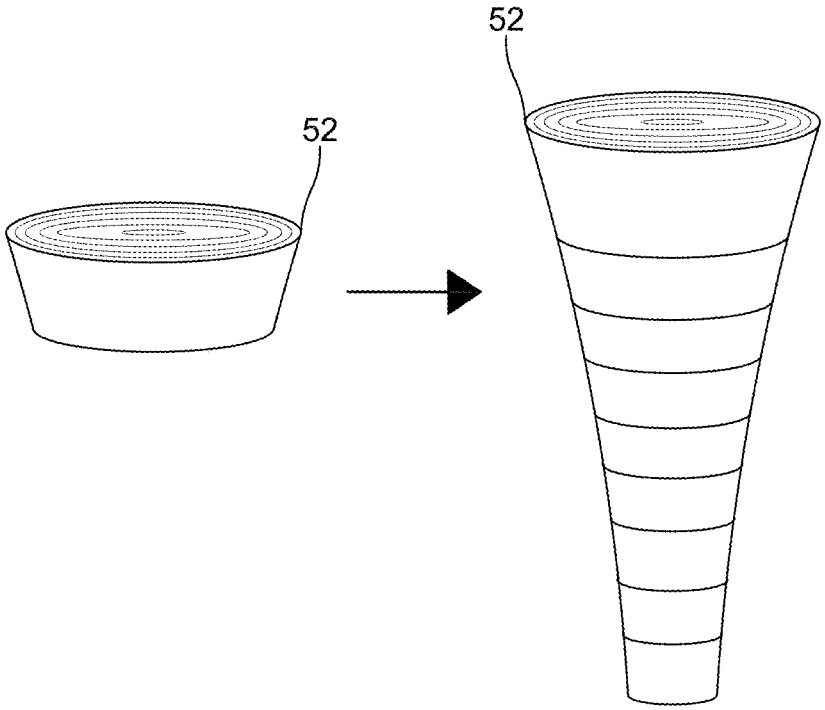

The shoe 20 further includes a heel assembly 50 that is mounted to the seat 36. As shown in FIG. 1, the heel assembly 50 has a collapsible exterior shell 52 and an actuator 54. As shown in FIGS. 4A, 4B, 5A, and 5B, exterior shell 52 is adjustable between an extended state, corresponding to the first configuration, shown in FIGS. 4A and 4B, and a compressed state, corresponding to the second configuration, shown in FIGS. 5A and 5B. With reference to FIGS. 6A and 6B, exterior shell 52 may include shell sections 53 that are configured to fit within one another so as to form a shell that telescopically extend and compress. For example, exterior shell 52 may include 28 shell sections 53 that are each between 3.0 mm and 4.0 mm in height, for example, between 3.25 and 3.75 mm in height or for example between 3.5 and 4.0 mm in height. Exterior shell 52 is configured to encase actuator 54 to provide a barrier to contamination, and also to enhance the visual appeal of the shoe 20.

Figure 7:
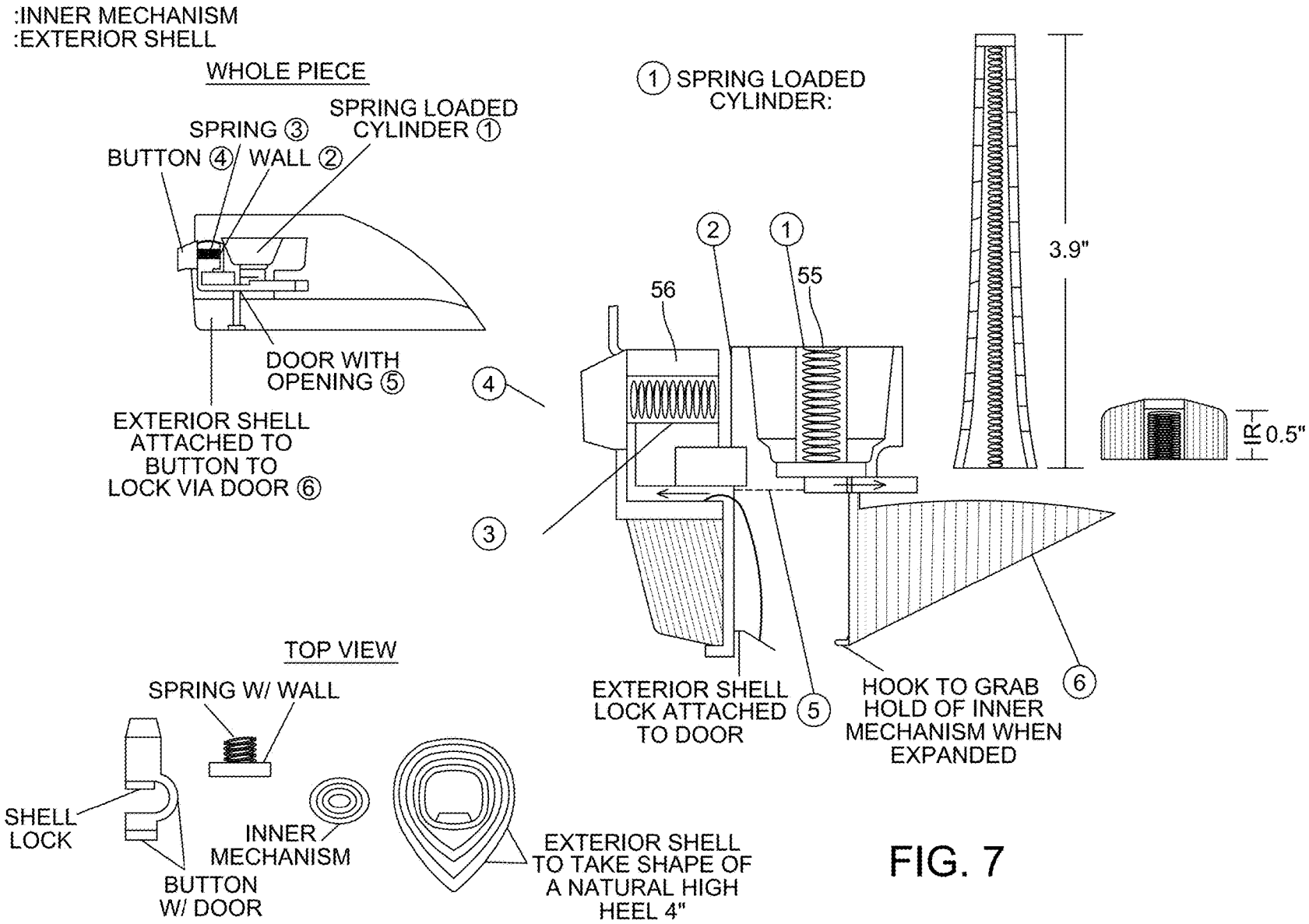
FIG. 7 includes schematics of a heel assembly, including a collapsible exterior shell and an actuator that includes a spring, with a push button that connects to a locking component for holding and releasing the spring.

Actuator 54 adjusts the shoe between the first height H1 and the second height H2. Actuator 54 may include various types of actuators. For example, in relation to FIG. 7, actuator 54 may include a spring 55 that is locked in a compressed state in the first height by locking mechanism 56. When spring 55 is released from its locked position, it expands so as to an expanded state having the second height. Spring 55 may then be again compressed back to the first height with sufficient force applied to the spring 55 in an axial direction along which the spring is elongate.

Figure 8A:
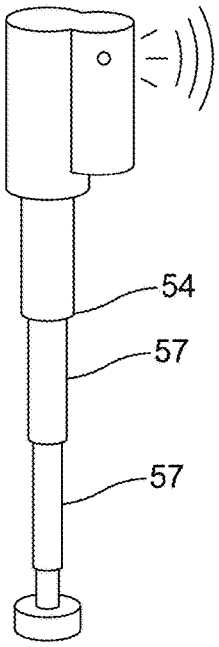
FIGS. 8A and 8B are schematic perspective views of linear actuators.
Figure 8B:
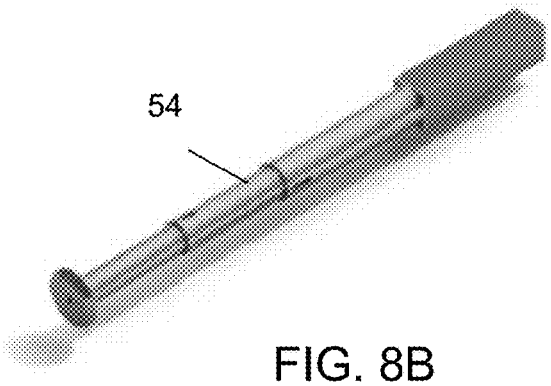
Figure 8C:
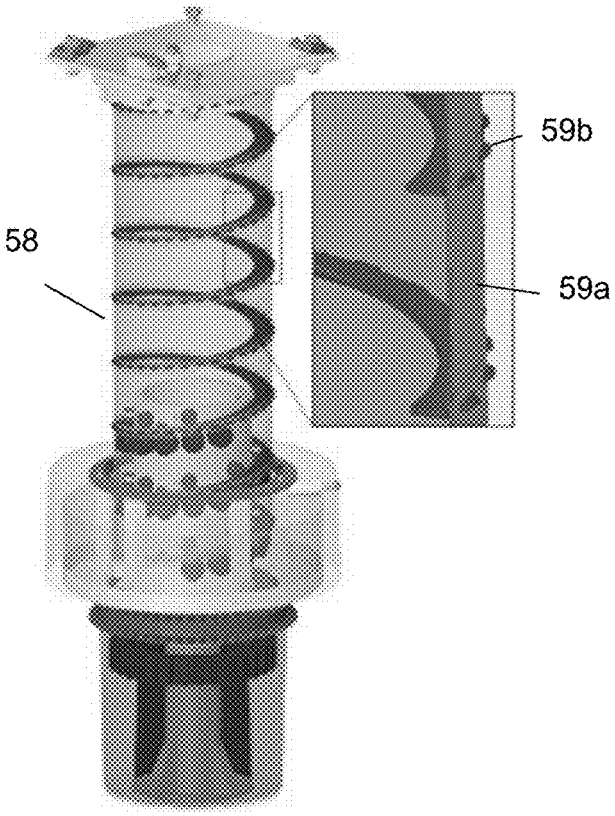
FIG. 8C is a schematic perspective view of a linear actuator that includes a spiral lift.

FIGS. 8A and 8B depict linear actuators that may alternatively be the actuator 54. For example, actuator 54 may be a telescopic linear actuator having multiple sections 57 that fit within each other. As shown in FIG. 8C, actuator 54 may alternatively include a spiral lift 58. Spiral lift 58 includes a pair of metal coils 59*a*, 59*b*. Coil 59*b* is disposed within coil 59*a* and as coil 59*a* expands axially, coil 59*b* provides locking mechanisms that extend through two layers of the coil 59*a* in order to lock the two layers in axial relation to one another. While not shown in the drawings, actuator 54 may alternatively include a hydraulic lift.

In some embodiments, actuator 54 may be configured to withstand an axial kinetic payload of up to 900 pounds (300 pound static payload) for up to 10 hours per day, five days per week over the course of one year. A pair of shoes 20, each having an actuatable support 54 may together be configured to withstand a minimal axial load of 350 pounds, with each actuator 54 configured to provide a lift strength of 175 pounds. Actuator 54 may be further configured to withstand lateral forces as would be expected to be encountered during wear. Actuator 54 may be powered by a small battery and motor assembly housed within the heel assembly 50.

Figure 9:
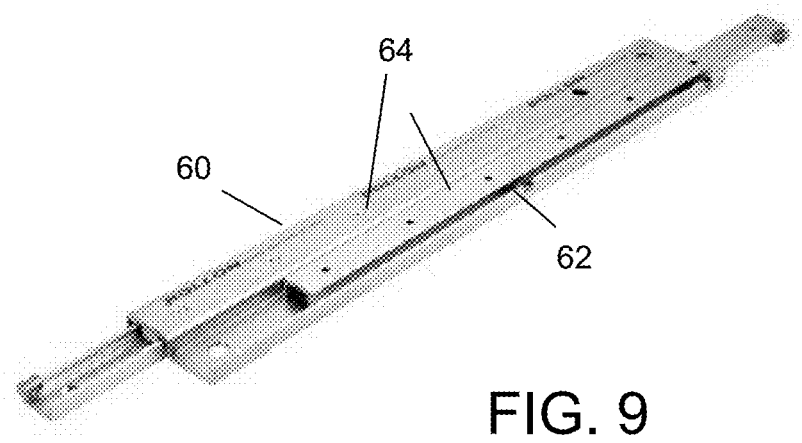
FIG. 9 is a schematic perspective view of a lateral stabilizer.
Figure 10:
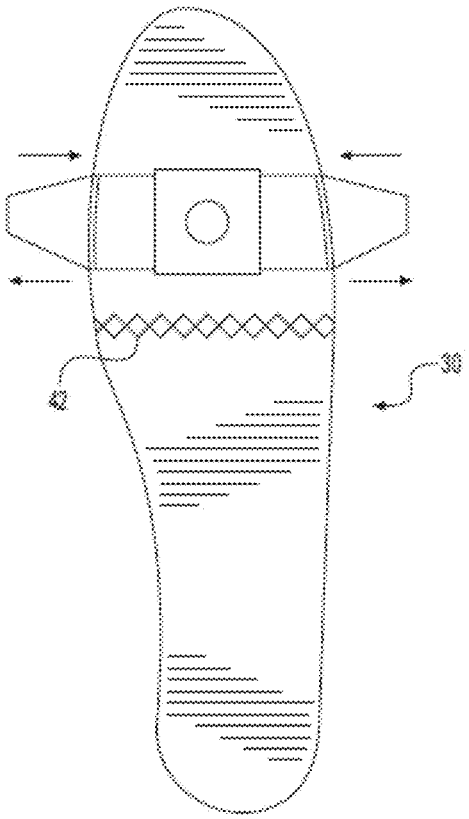
FIG. 10 is a schematic bottom view of a shoe having a lateral stabilizer.

With reference to FIGS. 9 and 10, shoe 20 may further include a lateral stabilizer 60. Lateral stabilizer 60 may be mounted to the toebox 32 and include a base 62 and a pair of laterally extending legs 64. Legs 64 are configured to extend parallel to an axis of rotation of the hinge 42 that connects toebox 32 relative to the shank 34. Lateral stabilizer 60 is configured such that in its compressed state, it is no wider than the portion of the toebox 32 to which it is mounted. For example, toebox 32 may have the same width as the lateral stabilizer 60 in its compressed state.

Figure 11:
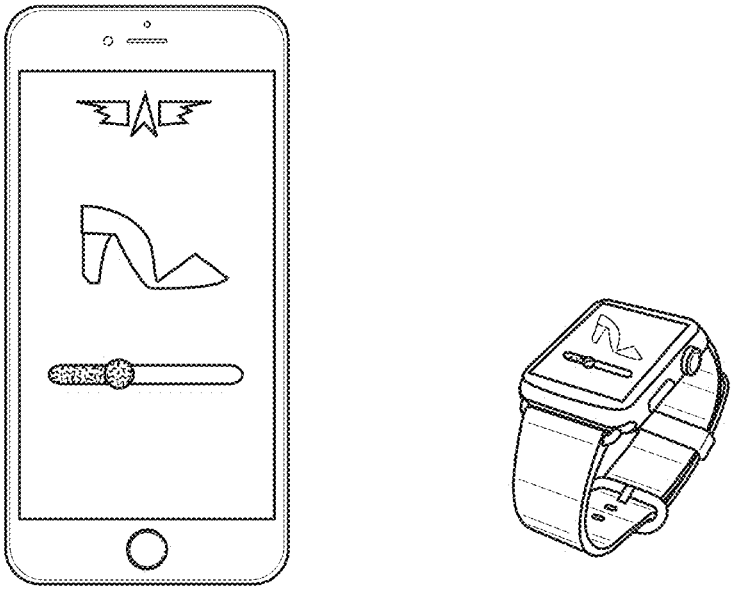
FIG. 11 includes schematics of smart devices including a smart phone and a smart watch that may be used to remotely control a pair of adjustable height shoes.
Figure 12:
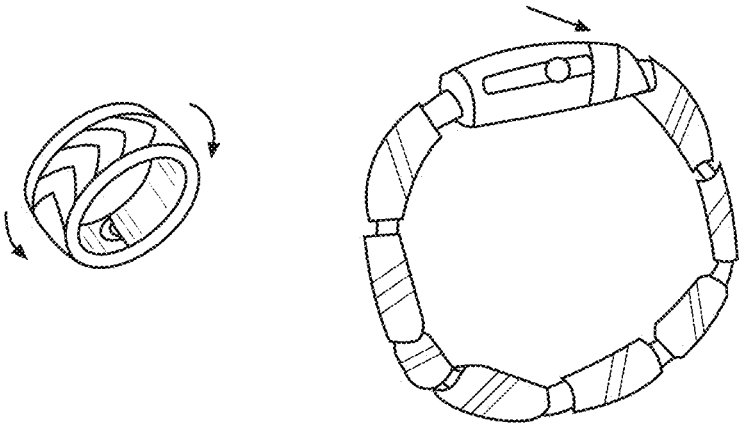
FIG. 12 includes schematics of jewelry that includes transponders adapted to remotely control a pair of adjustable height shoes.

Actuator 54 and lateral stabilizer 60 may be remotely controlled by a receiver mounted in the shoe 20 and a transponder disposed remotely relative to the shoe 20. For example, a smart device, such as a smart phone or smart watch (shown in FIG. 11) may include the transponder that is configured to send signals to the receiver in the shoe in order to effect actuation of the actuator 54 and the lateral stabilizer 60 (if the shoe has a lateral stabilizer). For example, the smart device may include an app in its interface through which the shoe height may be controlled. Alternatively, in relation to FIG. 12, a piece of jewelry, such as a bracelet or ring, may have a transponder that is configured to send signals to the receiver in the shoe in order to effect actuation of the actuator 54 and the lateral stabilizer 60 (if the shoe has a lateral stabilizer). A manual backup system may also be employed so that the user can manually adjust the shoe height by manipulating the shoe itself.

With reference now to FIGS. 14A-19B, a second shoe 120 is depicted. Shoe 120 has elements and properties that are similar to those described above in relation to shoe 20 and corresponding elements numbers are used to describe shoe 120. Shoe 120 is configured to adjust from a first configuration, shown in FIGS. 14A and B having a first height H1 to a second configuration, shown in FIG. 14C having a second height H2. The shoe includes a sole 130 that has a toebox 132, a shank 134, and a seat 136.

Figure 16A:
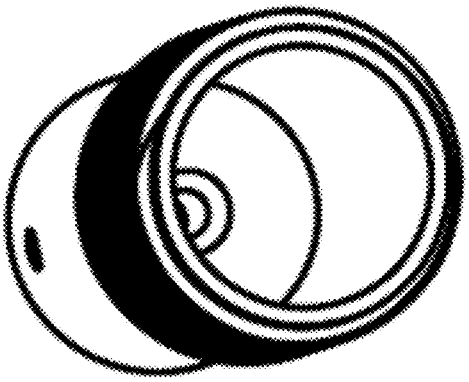
FIGS. 16A-C are views of a first component of the heel assembly shown in FIG. 15.
Figure 16B:
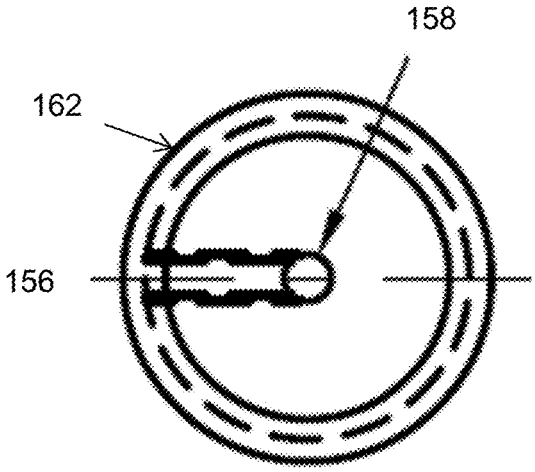
Figure 16C:
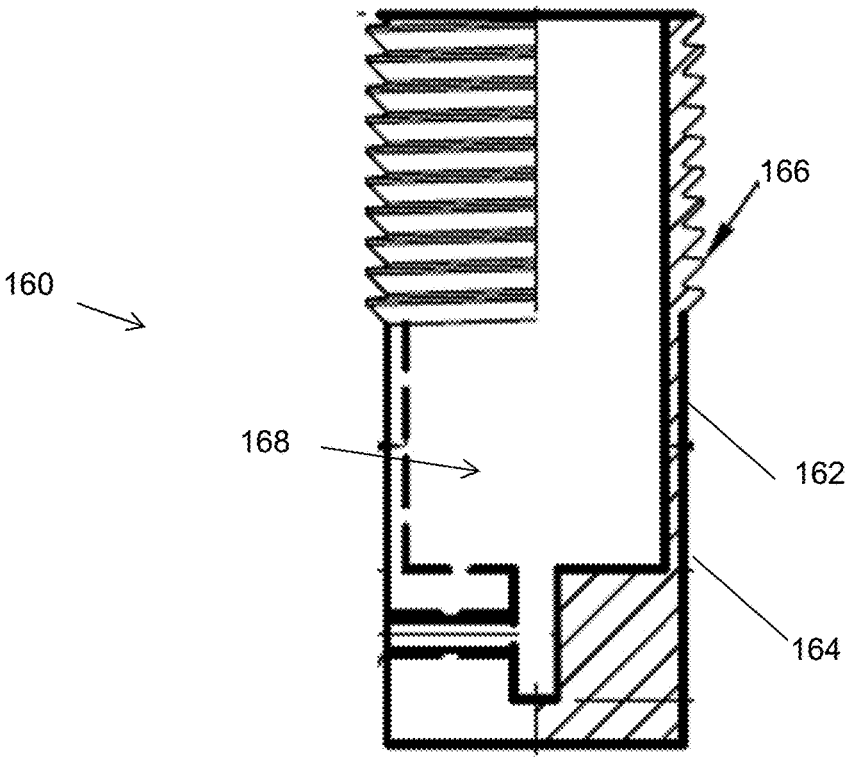
Figure 17A:
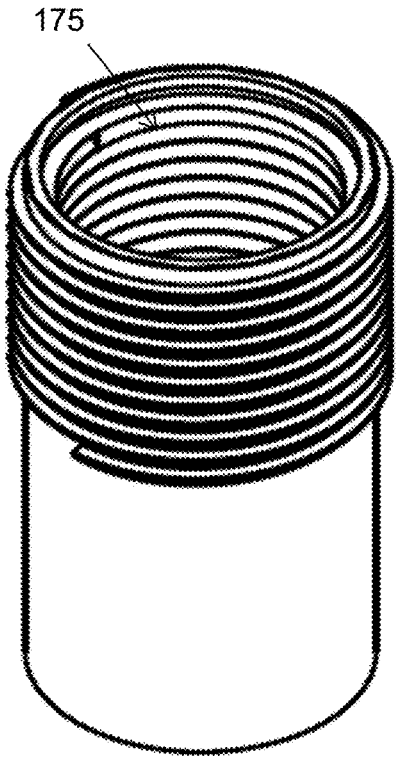
FIGS. 17A-C are views of a second component of the heel assembly shown in FIG. 15 that is disposed above the lower-most component shown in FIGS. 16A-C.
Figure 17B:
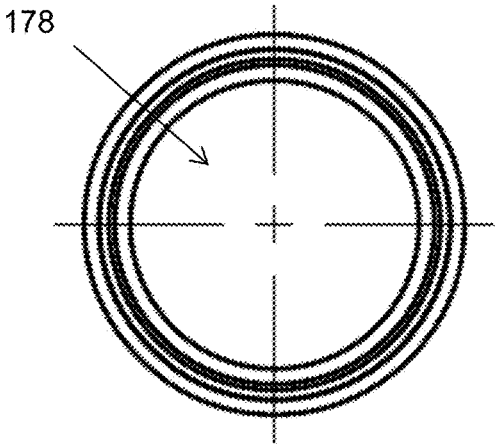
Figure 17C:
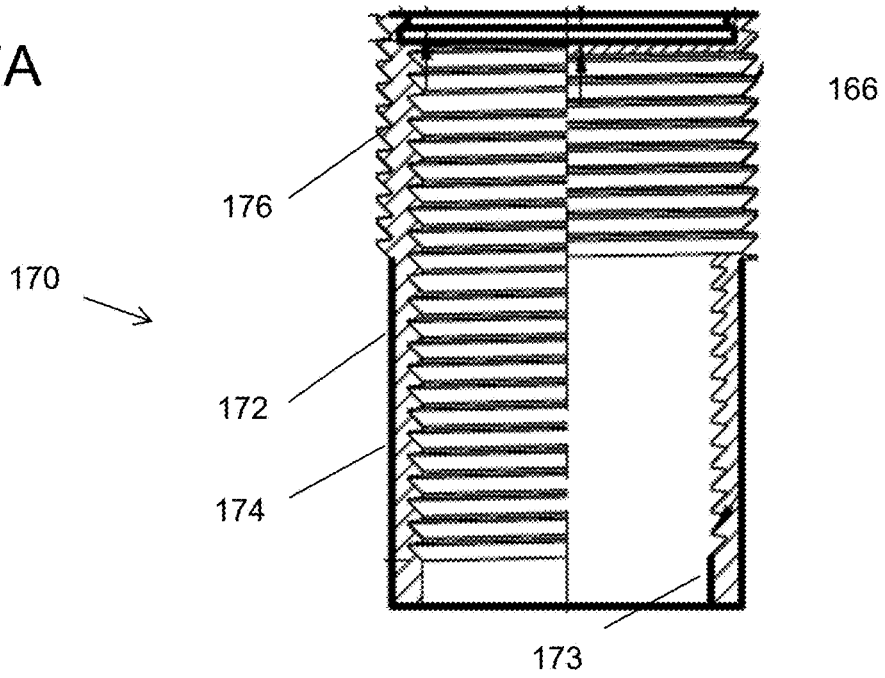

Shoe 120 also has a heel assembly 150 having a base 151 that is mounted to the seat 136. The heel assembly includes a shell 152 extending from the base 151. In some embodiments, the shell 152 is configured to entirely retract into the base 151. As shown in FIGS. 16A-C, the shell includes a first cylindrical component 160 that has a sidewall 162 having an outer surface 164 on which external threads 166 are disposed. With reference to FIGS. 17A-C, the shell also includes a second cylindrical component 170 that has a sidewall 172 that defines a recess 178 and has an inner surface 173 on which internal threads 175 are disposed. The internal threads 175 configured to mate with the external threads 166 such that the first cylindrical component and the second cylindrical component telescope in relation to one another as the shoe adjusts from the first configuration to the second configuration. The second cylindrical component 170 may also have an outer surface 174 on which external threads 176 are disposed.

With reference again to FIGS. 16A-C, in some embodiments, the first cylindrical component defines a recess 168 and the heel assembly further comprises an actuator 154 configured to rotate the first cylindrical component relative to the second cylindrical component such that the internal threads and the external threads slide in relation to one another. Actuator 154 may be powered by a battery 155 that is mounted on the shank 134 by a battery holder 153. For example, battery 155 may include one or more AA batteries. Alternatively, battery 155 may be self-powered, such as a solar or gyroscope battery. Actuator 154 is connected to the battery 155 by a wire 157. The heel assembly may further include a flange 156 that connects an output 158 of the actuator 154 to the sidewall 162 of the first cylindrical component 160. Like actuator 54, actuator 154 may be configured to withstand an axial kinetic payload of up to 900 pounds (300 pound static payload) for up to 10 hours per day, five days per week over the course of one year. A pair of shoes 120, each having an actuatable support 54 may together be configured to withstand a minimal axial load of 350 pounds, with each actuator 54 configured to provide a lift strength of 175 pounds. Actuator 54 may be further configured to withstand lateral forces as would be expected to be encountered during wear.

Figure 18A:
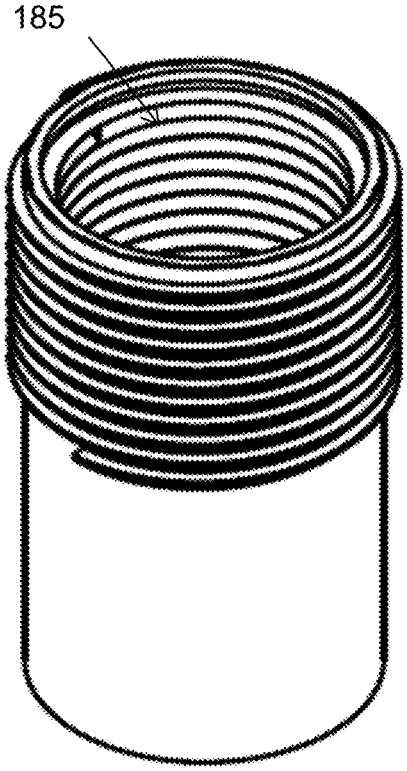
FIGS. 18A-C are views of a third component of the heel assembly shown in FIG. 15 that is disposed above the first and second components shown in FIGS. 16A-C and 17A-C.
Figure 18B:
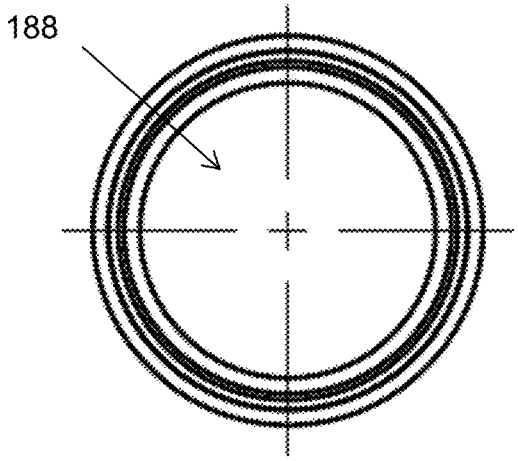
Figure 18C:
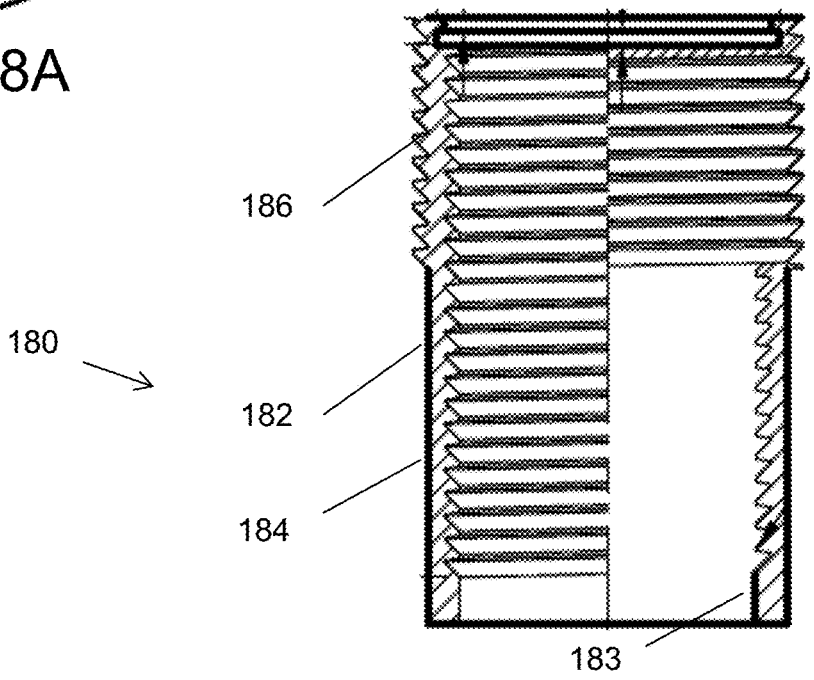

With reference now to FIGS. 18A-C, the shell may further include a third cylindrical component 180 that has a sidewall 182 that defines a recess 188 and has an inner surface 183 on which internal threads 185 are disposed. The internal threads are configured to mate with the external threads 176 of the second cylindrical component 170 such that the second cylindrical component and the third cylindrical component telescope in relation to one another as the shoe adjusts from the first configuration to the second configuration. The third cylindrical component 180 may also have an outer surface 184 on which external threads 186 are disposed.

Figure 19A:
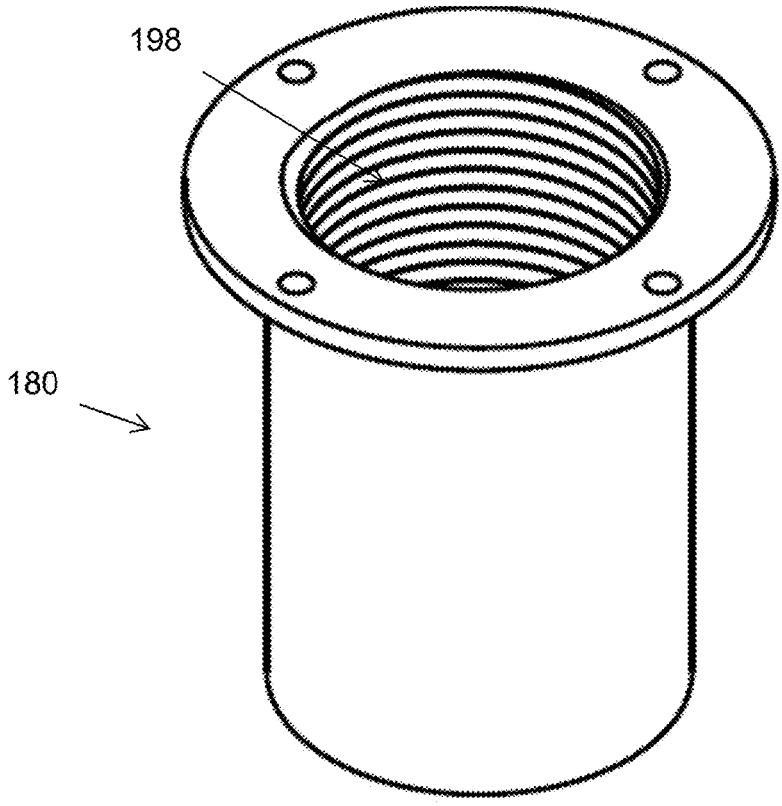
FIGS. 19A and B are views of a fourth component of the heel assembly shown in FIG. 15 that is disposed above the first, second, and third components shown in FIGS. 16A-C, 17A-C, and 18A-C.
Figure 19B:
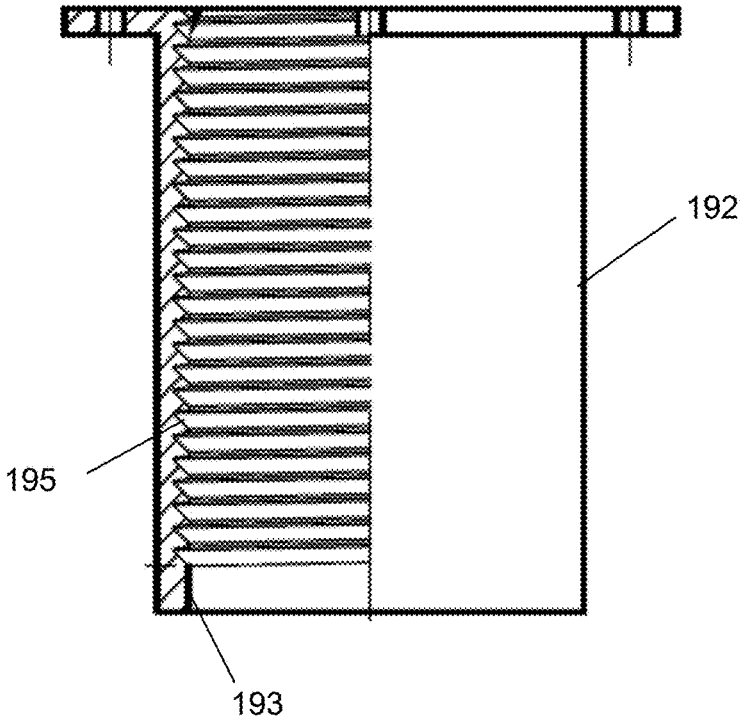

With reference now to FIGS. 19A-C, the shell may further include a fourth cylindrical component 190 that has a sidewall 192 that defines a recess 198 and has an inner surface 193 on which internal threads 195 are disposed. The internal threads are configured to mate with the external threads 186 of the third cylindrical component 180 such that the third cylindrical component and the fourth cylindrical component telescope in relation to one another as the shoe adjusts from the first configuration to the second configuration.

During operation, the wearer may actuate the actuator 54, 154 from the first configuration to a second configuration and from the second configuration to the first configuration in multiple ways. For example, the wearer may manually rotate first cylindrical component 160 relative to second cylindrical component 170 such that the first cylindrical component 160 telescopes within second cylindrical component 170. Similarly, second cylindrical component 170 may be manually rotated and telescoped within the third cylindrical component 180 which is, in turn, rotated and telescoped within the fourth cylindrical component. Alternatively, actuator 154 may be used to cause this rotation. In some embodiments, actuator 154 may provide a constant rotational force when the shoe is in its extended position so as to maintain the components' rotational position relative to one another. Actuator 54, 154 may be configured to adjust to incremental heights. For example, H1 may be 0.5 inches and H2 may be 4 inches and actuator 54 may be able to adjust to incremental heights of 1, 1.5, 2, 2.5, 3, and 3.5 inches.

Actuators 54, 154 may be activated using a manual button on the shoe that initiates the shoe's motor and battery assembly. Alternatively, the shoe's actuator 54, 154 may be controlled remotely. If the actuator 54, 154 is controlled remotely, the shoe 20, 120 may include an override function for when remote access is not available (e.g., when the battery dies or the smart device/remote dies or is otherwise not accessible). As the heel assembly 50, 150 moves between the first configuration and the second configuration, the toebox 32, 132 and the seat 36, 136 each rotate relative to the shank 34, 134 through hinges 42, 44, 142, 144 respectively. Hinges 42, 44, 142, 144 may lock the toebox 32, 132 and/or the seat 36, 136 in relative positions to the shank 34, 134 using the ratchet mechanism of each hinge.

As the heel assembly 50, 150 moves between the first configuration and the second configuration, the lateral stabilizer 60 may be in its extended position so as to provide lateral support to the wearer as the heel height is adjusted. Once the heel height has been adjusted, lateral stabilizer 60 may retract. Lateral stabilizer 60 may be controlled manually or remotely. Additionally, lateral stabilizer 60 may automatically extend whenever heel assembly 50, 150 is actuated.

Features of the disclosure which are described above in the context of separate embodiments may be provided in combination in a single embodiment. Conversely, various features of the disclosure that are described in the context of a single embodiment may also be provided separately or in any subcombination.

Changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the claims.

What is claimed:

1. A shoe configured to adjust from a first heel configuration having a first height to a second heel configuration having a second height, the shoe comprising:

a sole, the sole comprising a toebox portion, a shank portion, and a seat portion; and a heel assembly having a base mounted to the seat, the heel assembly being fixedly mounted to the seat portion at an angle relative to the seat portion such that the angle is maintained as the shoe is adjusted from the first heel configuration to the second heel configuration, and the heel assembly comprising a shell extending from the base, the shell comprising:

a first cylindrical component that has a sidewall having an outer surface on which external threads are disposed; and a second cylindrical component that has a sidewall that defines a recess and has an inner surface on which internal threads are disposed, the internal threads configured to mate with the external threads such that the first cylindrical component and the second cylindrical component telescope in relation to one another as the shoe adjusts from the first configuration to the second configuration, wherein the first cylindrical component defines a recess and the heel assembly further comprises an actuator configured to rotate the first cylindrical component relative to the second cylindrical component such that the internal threads and the external threads slide in relation to one another and wherein the second cylindrical component has an outer surface on which external threads are disposed and the shell further comprises a third cylindrical component that has a sidewall that defines a recess and has an inner surface on which internal threads are disposed, the internal threads configured to mate with the external threads of the second cylindrical component such that the second cylindrical component and the third cylindrical component telescope in relation to one another as the shoe adjusts from the first configuration to the second configuration.

2. The shoe of claim 1, wherein the heel assembly further comprises a flange that connects an output of the actuator to the sidewall of the first cylindrical component.

3. The shoe of claim 1 wherein the third cylindrical component has an outer surface on which external threads are disposed and the shell further comprises a fourth cylindrical component that has a sidewall that defines a recess and has an inner surface on which internal threads are disposed, the internal threads configured to mate with the external threads of the third cylindrical component such that the third cylindrical component and the fourth cylindrical component telescope in relation to one another as the shoe adjusts from the first configuration to the second configuration.

* * * * *